United States Patent [19]

Johnson et al.

[11] 4,159,003

[45] Jun. 26, 1979

[54] CONVERTIBLE WORK FEEDING DEVICE FOR SEWING MACHINES

[75] Inventors: Ralph E. Johnson, Convent Station; Louis F. Daman, Martinsville, both of N.J.

[73] Assignee: The Singer Company, New York, N.Y.

[21] Appl. No.: 894,465

[22] Filed: Apr. 10, 1978

[51] Int. Cl.[2] ..... D05B 27/00

[52] U.S. Cl. ..... 112/168; 112/324; 112/260

[58] Field of Search ..... 112/215, 216, 208, 209, 112/210, 168

[56] References Cited

U.S. PATENT DOCUMENTS

| | | | |
|---|---|---|---|
| 470,092 | 3/1892 | Woodward | 112/208 |
| 1,602,145 | 10/1926 | Avis | 112/208 |
| 3,320,912 | 5/1967 | Ketterer et al. | 112/210 |
| 3,320,913 | 5/1967 | Laidig | 112/215 |

*Primary Examiner*—Wm. Carter Reynolds

*Attorney, Agent, or Firm*—Robert E. Smith; William V. Ebs; Edward L. Bell

[57] ABSTRACT

A work feeding device for sewing machines is disclosed in which an auxiliary feed dog section is constrained closely adjacent to the needle hole on a straight stitch throat plate. The auxiliary feed dog section is formed with surfaces adapted snuggly to embrace at least one limb of a conventional feed dog of the type with wide spread side limbs suitable for accommodating zig-zag stitching. All of the motions are imparted to the auxiliary feed dog section by the conventional feed dog which it embraces.

7 Claims, 6 Drawing Figures

Fig. 6
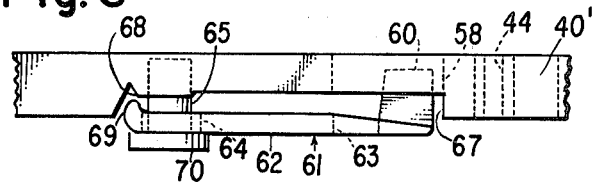
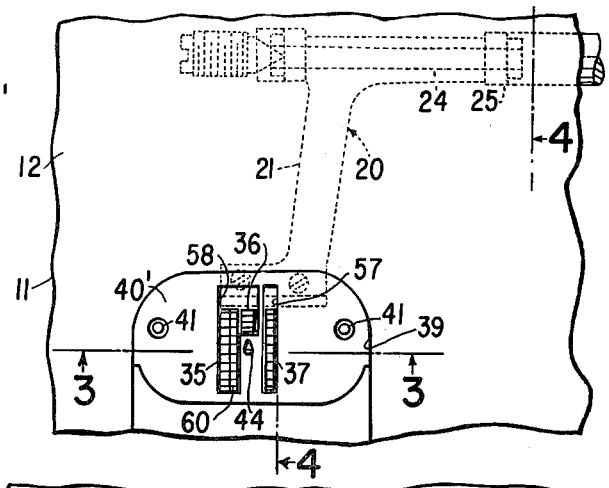
Fig. 1
Fig. 5
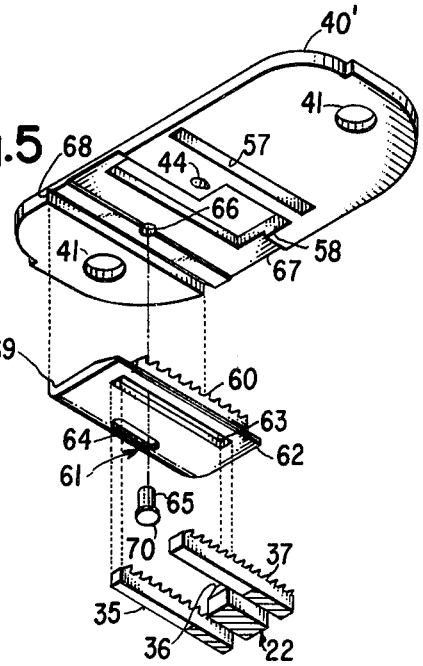
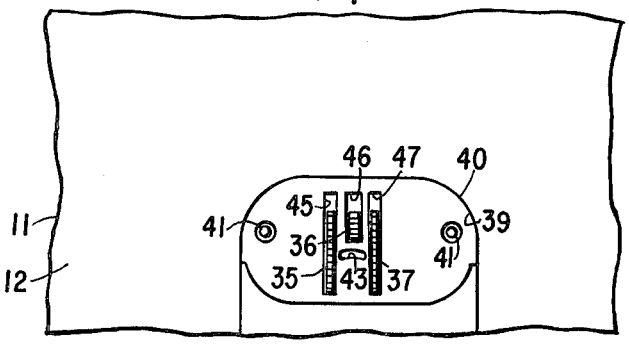
Fig. 2
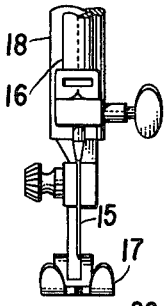
Fig. 3
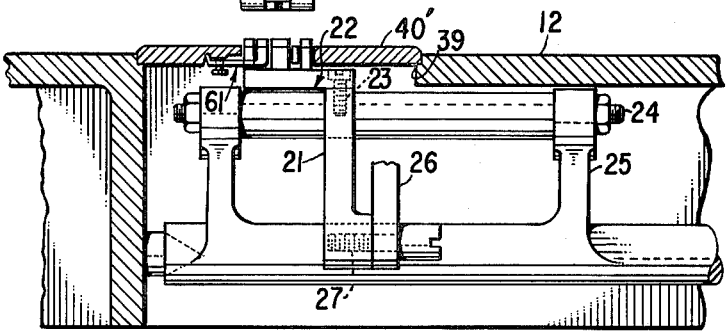
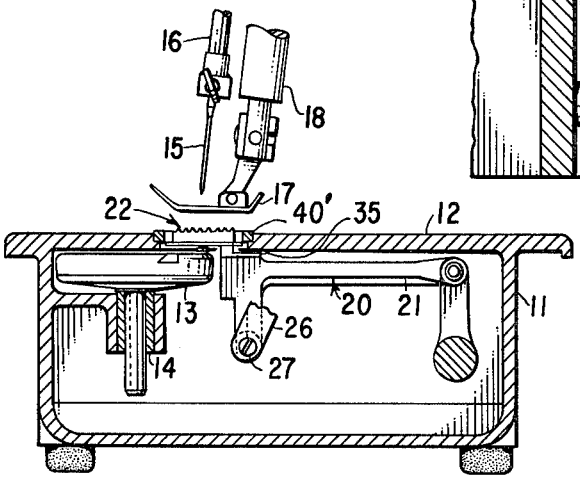
Fig. 4

CONVERTIBLE WORK FEEDING DEVICE FOR SEWING MACHINES

BACKGROUND OF THE INVENTION

This invention relates to work transporting feed dogs for sewing machines, and more particularly, to a novel work feed dog arrangement which may be converted readily to accommodate zig-zag or straight stitching.

For zig-zag sewing a throat plate with an elongated needle accommodating aperture as wide as the maximum zig-zag width is required and the side limbs of the work feed dog must be as widely spaced as the maximum zig-zag width. For straight stitching higher quality stitching may be performed if a throat plate with a constricted needle aperture is employed and improved work feeding will result, particularly when stitches are required to be placed close to the edge of a work panel, if at least one limb of the work feed dog is located closely adjacent to the throat plate needle aperture.

This, of course, can be accomplished by exchanging the entire feed dog in the machine but such exchange requires the use of tools, creates the problem of storage of loose parts, and involves the inconvenience of a series of manual operations.

The U.S. Pat. No. 3,320,912, May 23, 1967 of S. J. Ketterer et al discloses a solution to this problem of conversion between zig-zag and straight stitch work feed dog arrangements by providing a feed dog in which one limb is articulated so that it can be shifted quickly to influence the spacing between the feed dog limbs. The increased mass of the feed dog which this patented arrangement requires also increases the inertia forces which develop during operation of the work feed mechanism and the looseness of parts in the feed system gives rise to increased vibration, noise and wear in the feed system.

SUMMARY OF THE INVENTION

It is an object of this invention to provide in a drop feed mechanism for a sewing machine an arrangement in which the work feed dog may be converted readily and conveniently to cooperate alternatively to suit either a zig-zag throat plate or a straight stitch throat plate with a minimum of influence on the inertia and vibration in the system. This object of the invention is attained by the provision of an auxiliary feed dog section which is made captive and constrained on the straight stitch throat plate. The auxiliary feed dog section is formed with surfaces adapted snuggly to embrace at least one limb of a conventional feed dog of the type with wide spread limbs suitable for accommodating the zig-zag throat plate. The auxiliary feed dog section engages and derives all of its motions from the conventional zig-zag feed dog in the machine.

DESCRIPTION OF THE DRAWINGS

A preferred embodiment of this invention is illustrated in the accompanying drawings, in which:

FIG. 1 is a top plan view of a fragment of the work supporting bed of a sewing machine with a straight stitch throat plate having this invention applied thereto, and illustrating a sewing machine construction to which this invention is adapted to be applied, FIG. 2 is a top plan view of a fragment of the work supporting bed of the sewing machine of FIG. 1 showing a zig-zag stitch throat plate with a conventional feed dog in place on the sewing machine, FIG. 3 is a horizontal cross sectional view of the sewing machine work supporting bed taken substantially along line 3—3 of FIG. 1 and including a needle and presser device, FIG. 4 is a horizontal cross sectional view of the sewing machine work supporting bed taken substantially along line 4—4 of FIG. 1, and including a needle, loop taker, and presser device, FIG. 5 is an exploded perspective view showing the conventional feed dog suitable for zig-zag stitching, the straight stitch throat plate, the auxiliary feed dog section, and a means for constraining the auxiliary feed dog section thereon, FIG. 6 is an enlarged cross sectional view of the throat plate which is shown in FIG. 3 showing in greater detail the cooperative relation between the auxiliary feed dog section and the throat plate.

DETAIL DESCRIPTION OF THE INVENTION

Illustrated in the accompanying drawings is the bed portion 11 of a sewing machine having a work supporting surface 12. FIG. 4 includes illustration of the various stitch forming instrumentalities which influence formation of stitches in a work fabric on the work supporting surface of the sewing machine bed. These stitch forming instrumentalities include a loop taker 13 which may be journalled in a bearing 14 in the sewing machine bed, a needle 15 carried by a needle bar 16 above the sewing machine bed and arranged for endwise reciprocatory movement as well as lateral jogging movement in cooperation with the loop taker 13 to concatenate threads in the formation of stitches, a presser foot 17 carried by a presser bar 18, and a work feeding mechanism indicated generally at 20. The work feeding mechanism is of the type referred to as a four motion drop feed mechanism, and includes a feed bar 21 to which a feed dog 22 is secured as by one or more screws 23. The feed bar is connected by a pivot 24 to a feed advance rock frame 25, and a feed lift linkage 26 is pivotally connected as at 27 to the feed bar. Any well known actuating means may be employed for imparting of movements to the feed advance rock frame and the feed lift linkage to impart the work advancing and return movements to the feed dog together with rising and falling movements thereto into and out of engagement with the work fabric.

In the vicinity of the stitch forming instrumentalities described above, the work supporting surface 12 of the sewing machine bed 11 is formed with an opening 39 in which a throat plate 40 may be accommodated and secured by means of fastenings 41 which may comprise screws, locating pins, magnetic holding means, or the like. In order best to suit the conditions encountered when sewing various types of stitches, it is desirable that the throat plate 40 be exchangeable so that a throat plate may be employed which is particularly suited to the class of work intended to be performed on the machine. FIGS. 1 and 2 illustrate two different throat plates 40' and 40 respectively each accommodated in the same work supporting surface opening 39 and secured by identical fastening means 41, but each being adapted to accommodate different types of needle movement and different arrangements of the work feed mechanism. As shown in FIG. 2 the throat plate 40 is formed with a laterally elongated needle accommodating aperture 43 adapted to accommodate lateral jogging of the needle when zig-zag stitches are to be formed. The throat plate 40 with the zig-zag needle accommodating aperture 43 is formed with slots 45, 46 and 47 spaced to accommodate the rows of toothed work engaging ribs 35, 36 and 37 of the feed dog 22 which is carried by the feed bar 21.

As illustrated in FIG. 1 the throat plate 40' is formed with a substantially circular needle accommodating aperture 44 adapted to accommodate passage of the needle when straight stitches are being formed. The greater support which is afforded to the work fabrics by the circular aperture 44 when straight stitching is being accomplished is advantageous in minimizing flagging of the work and thus provides for a higher quality of stitching when jogging of the needle need not be accommodated. Also when the sewing machine is operated to form straight stitches, the stitching is frequently performed closely adjacent to one edge of a work fabric, as for instance, in top stitching operations. When this is being done it is desirable that one of the working engaging ribs of the feed dog be located closely adjacent to the needle path of reciprocation so that a work feeding influence may be exerted on each side of the line of stitches being formed in a work fabric.

To provide for such work feeding influence closely adjacent to the straight stitch needle aperture 44, the feed dog accommodating slots in the straight stitch throat plate of this invention are modified preferrably by increasing the width of the slot at one side of the needle aperture an amount substantially equal to the web between the slots 45 and 46 of the zig-zag throat plate 40. As a result, as shown in FIGS. 1 and 5, the straight stitch throat plate 40' includes a slot 57 at one side of the needle aperture for accommodating the toothed work engaging rib 37 of the zig-zag feed dog 22 as is the case with the zig-zag throat plate 40, but a single "L" shaped slot 58 is provided behind and at the opposite side of the needle aperture 44. The slot 58 accommodates the toothed work engaging ribs 35 and 36 of the zig-zag feed dog and includes a laterally enlarged portion which provides a clearance space between the rib 35 and the needle aperture 44.

As best illustrated in FIGS. 1 and 5, a toothed work engaging rib 60 of an auxiliary feed dog section 61 is accommodated alongside the rib 35 of the zig-zag feed dog 22 in the laterally enlarged portion of the throat plate slot 58. The rib 60 on the auxiliary feed dog section extends upwardly from along one side edge of a base plate 62 which is formed alongside the rib 60 with an aperture 63 substantially identical in shape with the vertical projection of the feed section 35 of the main feed dog which is the space ad astra above the feed section 35 as indicated by dotted lines in FIG. 5 for snuggly accommodating the rib 35 of the feed dog 22.

The base plate 62 is also formed adjacent to the opposite side edge from the work engaging rib with a fastening accommodating aperture 64 which is elongated in a direction substantially parallel with the aperture 63 and through which passes a headed rivet 65 secured in a blind socket 66 beneath the straight stitch throat plate 40'.

The underside of the throat plate 40' is formed with a shallow recess 67 into which the base plate 62 of the auxiliary feed dog section 61 fits. The base plate 62 can fit into the shallow recess 67 and occupy a position therein substantially parallel to the throat plate as shown in FIG. 6 because the base plate is made flat. Along that edge of the recess 67 which is remote from the throat plate slot 58, the recess 67 is formed with a deeper channel 68 substantially parallel to the feed dog slots 57 and 58 opposite which channels is arranged an upturned flange 69 formed on the auxiliary feed dog section.

As shown best in FIG. 6, the rivet 65 is formed with a head 70 spaced sufficiently from the bottom of the recess 67 to provide freedom or clearance for vertical movement of the auxiliary feed dog section without permitting disengagement of the flange 69 or of the toothed work engaging rib 60 of the auxiliary feed dog section from the recess 67. With this arrangement, a single fastening element such as the rivet 65 can be used to secure the auxiliary feed dog section in a manner such that it will not be free to turn but will always be constrained within the recess 67 and generally aligned with the feed dog work engaging rib 35 for ready accommodation on a sewing machine. Preferrably the rivet 65 is located closer to the flange 69 and closely adjacent to that side edge of the flat base plate 62 which is opposite the work engaging rib 60 than to the work engaging rib 60, thus providing for increased vertical movement of the work engaging rib.

With the convertible feeding device of this invention as described above, the change from zig-zag sewing to straight stitch sewing is very convenient; the zig-zag throat plate 40 is simply removed and the straight stitch throat plate 40' is substituted in its place. The auxiliary feed dog section 61 is maintained captive beneath the straight stitch throat plate 40' and moreover, is maintained substantially in alignment with the sewing machine feed dog work engaging ribs by the recess 67 in which it is constrained so that at most only minor shift of the auxiliary feed dog section is required to position the aperture 63 thereof in embracing relation over the rib 35 of the feed dog.

With the straight stitch throat plate 40' in place on the sewing machine bed and the auxiliary feed dog section embracing the main feed dog, the auxiliary feed dog section will partake of all of the movements of the main feed dog; the head 70 of the rivet 65 being spaced with sufficient clearance from the throat plate such as to accommodate such movements while maintaining the work engaging rib 60 of said auxiliary feed dog within said laterally enlarged straight stitch throat plate slot portion as shown in FIG. 6.

A minimum of added mass and inertia of moving parts on the feed bar is involved with the conversion device of this invention, and the main feed dog 22 remains securely fastened to the feed bar, no pivotal or sliding connections with consequent troublesome looseness, noise or wear is involved.

The auxiliary feed dog section 61 provides for a work feeding element closely adjacent to the path of needle reciprocation during straight stitching so that top stitching very close to the edge of a work piece may be accomplished readily.

Having set forth the nature of this invention, what is claimed herein is:

1. A convertible work feeding device for a sewing machine having a frame with a work supporting bed, a needle selectively capable of being reciprocated in a fixed path to sew straight stitches or jogged laterally to sew zig-zag stitches, a work feeding mechanism including a feed bar shiftably supported in said bed, a main feed dog secured on said feed bar and including work engaging feed sections at each side laterally spaced a distance greater than the maximum lateral jogging movement of which the needle is capable, mechanism operatively connected to said feed bar for imparting work feeding motion to said main feed dog; and means on said bed exchangeably accommodating either a zig-zag or a straight stitch throat plate, said zig-zag throat plate being formed with slots accommodating said laterally spaced feed sections of said main feed dog and including a laterally elongated needle aperture between said feed section accommodating slots, said convertible work feeding device comprising a straight stitch throat plate adapted for accommodation on said work supporting bed and formed with slots accommodating said laterally spaced feed sections of said main feed dog and a substantially circular needle aperture formed between said feed section accommodating slots, at least one of said feed section accommodating slots in said straight stitch throat plate being formed with a laterally enlarged portion extending closely adjacent to said needle aperture, an auxiliary feed dog, a work engaging rib formed on said auxiliary feed dog for accommodation in said laterally enlarged portion of said one feed section accommodating slot of said straight stitch throat plate, interengaging means formed on the main and auxiliary feed dogs coupling said main and auxiliary feed dogs for movement together, and means for constraining said auxiliary feed dog on said straight stitch throat plate with capacity for motion with said main feed dog.

2. A convertible work feeding device as set forth in claim 1 in which said means for constraining said auxiliary feed dog on said straight stitch throat plate comprises a headed fastener fixed beneath said throat plate, said auxiliary feed dog being formed with a fastener accommodating slot extending substantially parallel to said work engaging rib thereon, the clearance between said throat plate and the head of said fastener being sufficiently limited so as to maintain the work engaging rib of said auxiliary feed dog within said laterally enlarged straight stitch throat plate slot portion.

3. A convertible work feeding device as set forth in claim 1 in which said auxiliary feed dog is formed with an opening substantially identical in shape with the vertical projection of one of said laterally spaced work engaging feed sections of said main feed dog for providing said interengaging means between said main and auxiliary feed dogs.

4. A convertible work feeding device as set forth in claim 1 in which said auxiliary feed dog includes a flat base plate arranged substantially parallel beneath said straight stitch throat plate and from which base plate said work engaging rib of said auxiliary feed dog projects, and in which said flat base plate is formed with an opening substantially identical in shape with the vertical projection of one of said laterally spaced work engaging feed sections of said main feed dog for providing said interengaging means between said main and auxiliary feed dogs.

5. A convertible work feeding device as set forth in claim 4 in which said means for constraining said auxiliary feed dog on said straight stitch throat plate comprises a headed fastener fixed beneath said throat plate, said flat base plate of and auxiliary feed dog being formed with a fastener accommodating slot extending substantially parallel to said work engaging rib thereon, the clearance between said throat plate and the head of said fastener being sufficiently limited so as to maintain the work engaging rib of said auxiliary feed dog within said laterally enlarged straight stitch throat plate slot portion.

6. A convertible work feeding device as set forth in claim 5 in which the underside of said straight stitch throat plate is formed with a recess in which said headed fastener constrains said flat base plate of said auxiliary feed dog.

7. A convertible work feeding device as set forth in claim 6 in which said flat base plate includes edges on opposite sides thereof and in which the work engaging rib of said auxiliary feed dog is formed along one side edge of said flat base plate, in which said fastener accommodating slot is formed closely adjacent to the opposite side edge of said flat base plate, in which said opposite side edge of said flat base plate is formed with an upstanding flange which is constrained by said headed fastener opposite a groove formed in said recess beneath said straight stitch throat plate.

* * * * *